US009791239B1

(12) United States Patent
Kincel et al.

(10) Patent No.: US 9,791,239 B1
(45) Date of Patent: Oct. 17, 2017

(54) FIREARM HANDGUARD ASSEMBLY

(71) Applicant: Bravo Company MFG, Inc., Hartland, WI (US)

(72) Inventors: Eric Stephen Kincel, Las Vegas, NV (US); Jeffrey James O'Brien, Las Vegas, NV (US)

(73) Assignee: Bravo Company Mfg. Inc., Hartland, WI (US)

( * ) Notice: Subject to any disclaimer, the term of this patent is extended or adjusted under 35 U.S.C. 154(b) by 0 days.

(21) Appl. No.: 15/153,464

(22) Filed: May 12, 2016

(51) Int. Cl.

| | |
|---|---|
| ***F41C 23/16*** | (2006.01) |
| ***F41A 3/66*** | (2006.01) |
| ***F41A 21/48*** | (2006.01) |
| ***F41A 5/18*** | (2006.01) |

(52) U.S. Cl.
CPC ..... *F41C 23/16* (2013.01); *F41A 3/66* (2013.01); *F41A 5/18* (2013.01); *F41A 21/482* (2013.01)

(58) Field of Classification Search
CPC ..... F41C 23/16; F41A 11/00; F41A 11/02; F41A 3/66; F41A 5/18; F41A 21/482
USPC ..... 42/71.01, 75.01, 75.02, 75.03
See application file for complete search history.

(56) References Cited

U.S. PATENT DOCUMENTS

| | | | | |
|---|---|---|---|---|
| 7,216,451 | B1 * | 5/2007 | Troy | F41C 23/16 42/71.01 |
| 7,770,317 | B1 | 8/2010 | Tankersley | |
| 8,051,595 | B2 * | 11/2011 | Hochstrate | F41A 5/18 42/75.01 |
| 8,438,770 | B2 | 5/2013 | Troy | |
| 8,607,490 | B1 | 12/2013 | Zinsner | |
| 8,739,448 | B2 * | 6/2014 | Kimmel | F41C 23/16 42/124 |
| 8,904,691 | B1 * | 12/2014 | Kincel | F41C 23/16 42/71.01 |
| 2011/0126443 | A1 | 6/2011 | Sirois | |
| 2011/0192066 | A1 * | 8/2011 | Kimmel | F41C 23/16 42/71.01 |
| 2012/0042557 | A1 * | 2/2012 | Gomez | F41C 23/16 42/90 |
| 2012/0124880 | A1 | 5/2012 | Leclair | |
| 2012/0186123 | A1 | 7/2012 | Troy et al. | |
| 2014/0026459 | A1 * | 1/2014 | Yan | F41C 23/16 42/71.01 |
| 2014/0130390 | A1 * | 5/2014 | Geissele | F41C 23/16 42/71.01 |
| 2014/0373419 | A1 * | 12/2014 | Leclair | F41C 23/16 42/71.01 |
| 2015/0369555 | A1 * | 12/2015 | Daniel | F41A 21/485 42/75.02 |

FOREIGN PATENT DOCUMENTS

| | | | |
|---|---|---|---|
| WO | 2013010515 | A1 | 1/2013 |

* cited by examiner

*Primary Examiner* — Joshua Freeman
(74) *Attorney, Agent, or Firm* — Michael Best & Friedrich LLP

(57) ABSTRACT

A firearm handguard assembly system is disclosed. The system comprises a handguard including at least four apertures, a barrel nut having a first threaded end and a second smooth end, the threaded end coupled to the handguard, and an index block including at least four apertures, the index block coupled to the handguard by at least four screws, each screw having a head and a tip, the tip threaded through: one of the at least four apertures on the index block, and one of the at least four apertures on the handguard.

14 Claims, 14 Drawing Sheets

FIREARM HANDGUARD ASSEMBLY

TECHNICAL FIELD

The present invention generally concerns firearm equipment. More particularly, the present invention relates to a firearm handguard assembly.

BACKGROUND OF THE INVENTION

Traditionally, a handguard is mounted to a firearm using an assembly that uses a basic clamp on the handguard (which may or may not be integrated with the handguard itself) with a slice-bottom design, wherein the bottom portion of the clamp is held together with screws, a two-sided slice design, or a multi-part clamp design. When the screws are tightened, the clamp bears down on the handguard, holding the handguard to the barrel nut. The barrel nut holds the barrel of the firearm in place and is attached to the upper receiver. However, this design is problematic. The tension created by the clamp holds the handguard in place on the barrel nut, but places stress on the upper area of the handguard, which is weaker due to design constraints. This area expands as the clamping mechanism is tightened and more so when the firearm is in use due to the heat generated between the barrel of the firearm, which causes the stress imparted by the clamp to relax as the parts expand due to heat. Traditional designs have placed their hardware in a disadvantaged location due to the lack of clearance available between the various components on top of the barrel nut. There is, therefore, a need for an improved firearm handguard assembly system that obviates the shortcomings of the traditional clamping design.

Similarly, even when a handguard is properly mounted to a firearm, the movement of the handguard may loosen the barrel nut and could result in damage to the firearm. Several solutions have been offered to index the handguard to the upper receiver of the firearm. The most common solution is an anti-slip plate that is affixed to the barrel nut using several screws. This type of assembly can be complicated and time-consuming for the user. Yet another design is a handguard with an indexing tab (or "finger") that extends from the handguard and indexes to the upper receiver of the firearm. Therefore, there is a need for an indexing system that is simple and user-friendly.

The present invention is aimed at one or more of the problems identified above.

BRIEF DESCRIPTION OF THE DRAWINGS

Other advantages of the present invention will be readily appreciated as the same becomes better understood by reference to the following detailed description when considered in connection with the accompanying drawings wherein:

FIG. 1I illustrates a fully assembled firearm handguard assembly system on an exemplary firearm according to a first embodiment;

Corresponding reference characters indicate corresponding parts throughout the drawings.

SUMMARY OF THE INVENTION

In one aspect of the present invention, a firearm handguard assembly system is disclosed. The system comprises a handguard, a barrel nut, and an index block. The handguard has at least four apertures. The barrel nut has first threaded end and a second smooth end. The threaded end is coupled to the handguard. The index block includes at least four apertures. The index block is coupled to the handguard by at least four screws. Each screw has a head and a tip. The tip of each screw is threaded through one of the apertures on the index block and one of the apertures on the handguard.

In another aspect of the present invention, a firearm is disclosed. The firearm includes an upper receiver, a handguard including at least four apertures; and a handguard assembly system. The handguard assembly system is used for mounting the handguard to the upper receiver. The handguard assembly system includes a barrel nut having a first threaded end and a second smooth end, the threaded end coupled to the handguard. The handguard assembly system further includes an index block including at least four apertures. The index block is coupled to the handguard by at least four screws, each screw having a head and a tip. The tip of each screw is threaded through one of the apertures on the index block and one of the apertures on the handguard.

DETAILED DESCRIPTION OF THE INVENTION

Embodiments of the present invention provide a handguard assembly and system and method of mounting the assembly to a firearm. Persons of ordinary skill in the art will realize that the following description of the presently invention is illustrative only and not in any way limiting. Other embodiments of the invention will readily suggest themselves to such skilled persons.

Other improved designs have included the use of clamp blocks, cross bolts, and an indexing plate, as described in U.S. Pat. No. 8,904,691, issued to Eric S. Kincel, which is incorporated herein by reference. The design of the present invention uses screws and an index clamp rather than cross bolts and a plurality of clamp blocks.

Figure 1A:
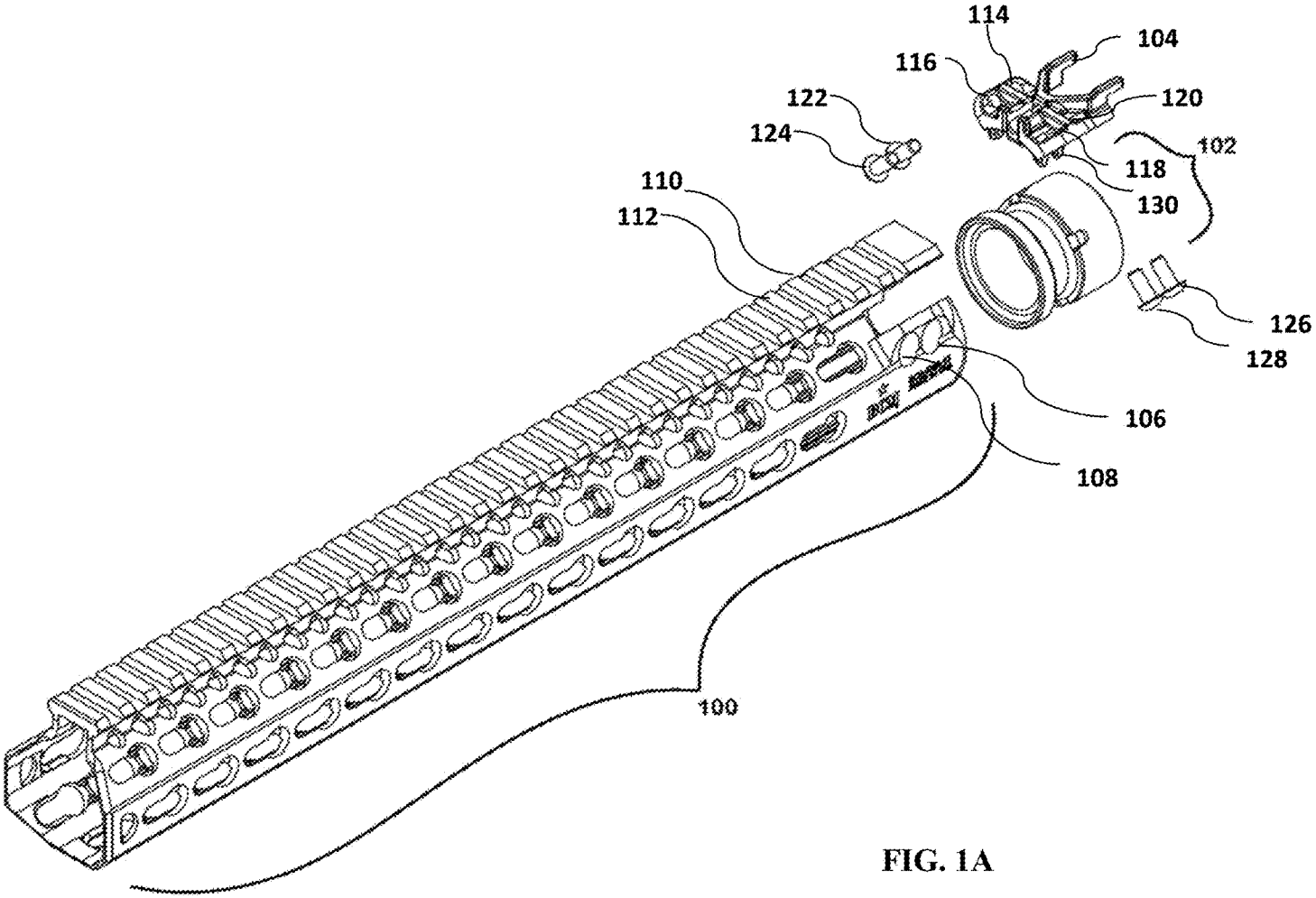
FIG. 1A illustrates an exploded view of an exemplary handguard assembly according to a first embodiment.

Referring now to FIG. 1A, illustrating an exploded view of a firearm handguard assembly system according to a first embodiment, a handguard 100 is coupled to a threaded end of barrel nut 102 to mount the upper receiver of a firearm (FIG. 1I) to handguard 100.

It is contemplated that any handguard may be used in connection with the present invention. In a preferred embodiment, the handguard is made from magnesium rather than aluminum, the typical material for handguards in the industry. Magnesium is lighter than aluminum by a ratio of 1:3, and is therefore an ideal structural material for handguards because it reduces strain on the firearm user during use. However, handguards made from any suitable structural material may be used in connection with the present invention, including without limitation steel (carbon and stainless), aluminum, and titanium.

It is also contemplated that the handguard may contain KeyMod holes, a picatinny rail (also known as a MIL-STD-1913 accessory rail), Magpul® M-LOK® System, GIBBZ Arms™ Modular Attachment (GAMA) System, and/or any other interface system currently available or later developed.

According to the first embodiment, the threaded end of barrel nut 102 is placed inside a first end of handguard 100. Without an index block or plate, the movement of the handguard may loosen the barrel nut and could result in damage to the firearm. Use of index block 104 eliminates rotation of handguard 100 during use.

A first end of handguard 100 contains a first aperture 106 and a second aperture 108 on a first side, and a third aperture 110 and a fourth aperture 112 on a second side. Index block 104 contains a first aperture 114 and a second aperture 116 on a first side, and a third aperture 118 and a fourth aperture 120 on a second side. Index block 104 is placed inside the first end of handguard 100 such that first aperture 114 of index block 104 is aligned with first aperture 106 of handguard 100 and second aperture 116 of index block 104 is aligned with second aperture 108 of handguard 100. On the second side of index block 104, third aperture 118 of index block 104 is aligned with third aperture 110 of handguard 100 and fourth aperture 120 of index block 104 is aligned with fourth aperture 112 of handguard 100.

A first screw 122 is threaded through first aperture 106 of handguard 100 and first aperture 114 of index block 104. A second screw 124 is threaded through second aperture 108 of handguard 100 and second aperture 116 of index block 104. A third screw 126 is threaded through third aperture 110 of handguard 100 and third aperture 118 of index block 104. A fourth screw 128 is threaded through fourth aperture 112 of handguard 100 and fourth aperture 120 of index block 104.

Index block 104 further includes feet, one of which is labeled 130, which interface with barrel nut 102.

During threading as described above, screws 122, 124, 126, and 128 preclude longitudinal movement of handguard 100, while clamping down on the body of handguard 100 to cause residual force between barrel nut 102 and handguard 100. On an AR-15 platform, the mounting force is spread around the firearm's gas tube (see FIG. 1H). The residual mounting force prevents the handguard from flexing or growing, which ultimately prevents rotation and slippage during use.

Figure 1B:
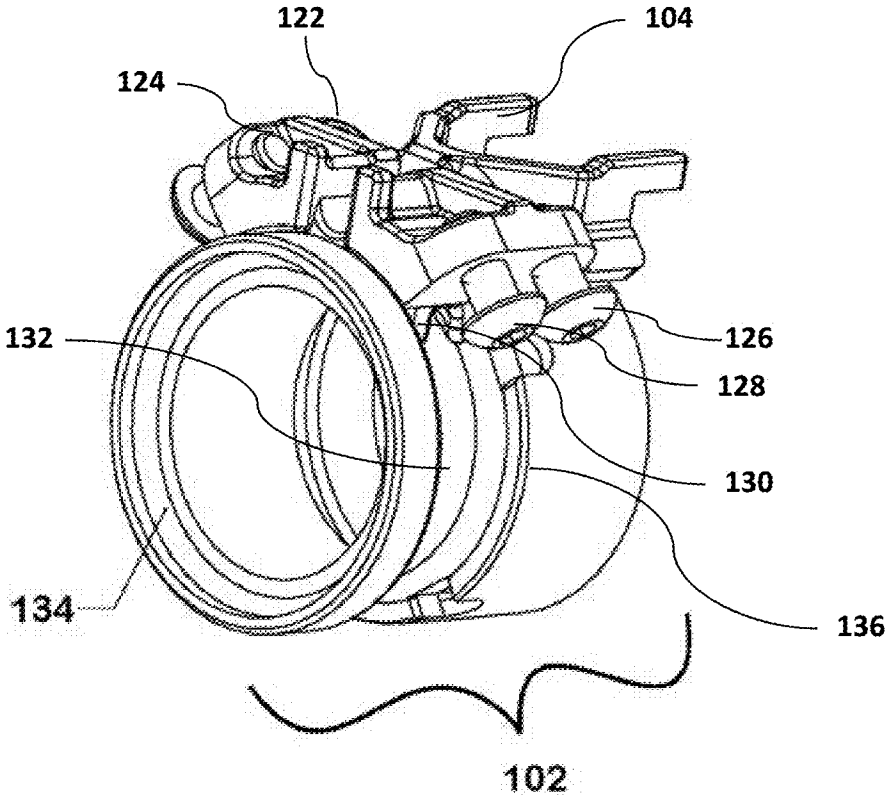
FIG. 1B illustrates a side perspective view of an index block of an exemplary handguard assembly according to a first embodiment.

Referring now to FIG. 1B, a side perspective view of index block 104 and barrel nut 102 of an exemplary handguard assembly according to the first embodiment is shown. Screws 122, 124, 126, and 128 are threaded through index block 104. Feet 130 of index block 104 interface with barrel nut 102 in a groove 132 between a first lip 134 of the threaded end barrel nut 102 and a second lip 136 of the smooth end of barrel nut 102.

Figure 1D:
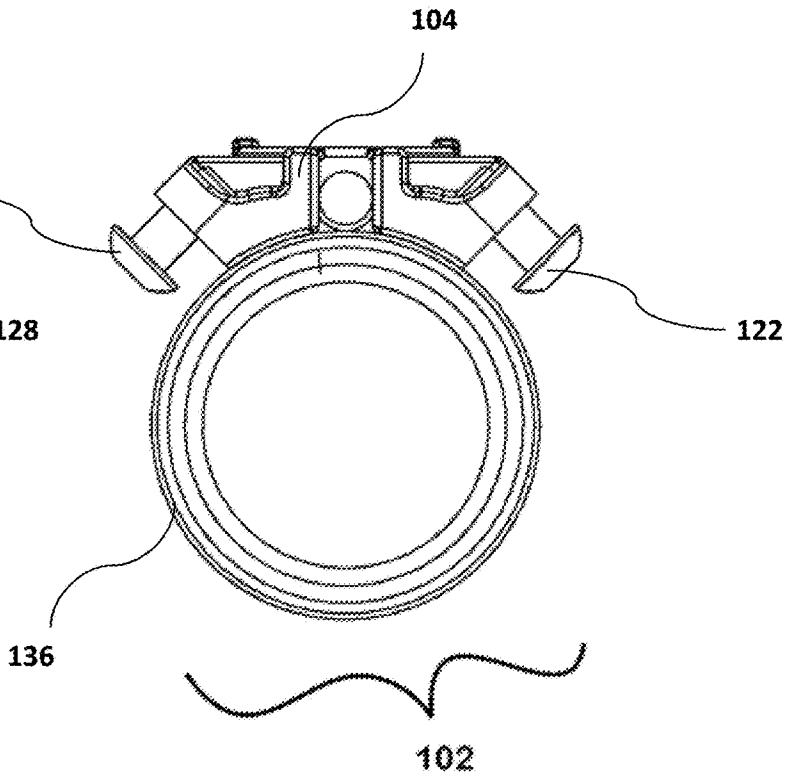
FIG. 1D illustrates a back view of an index block and a barrel nut of an exemplary handguard assembly according to a first embodiment.
Figure 1C:
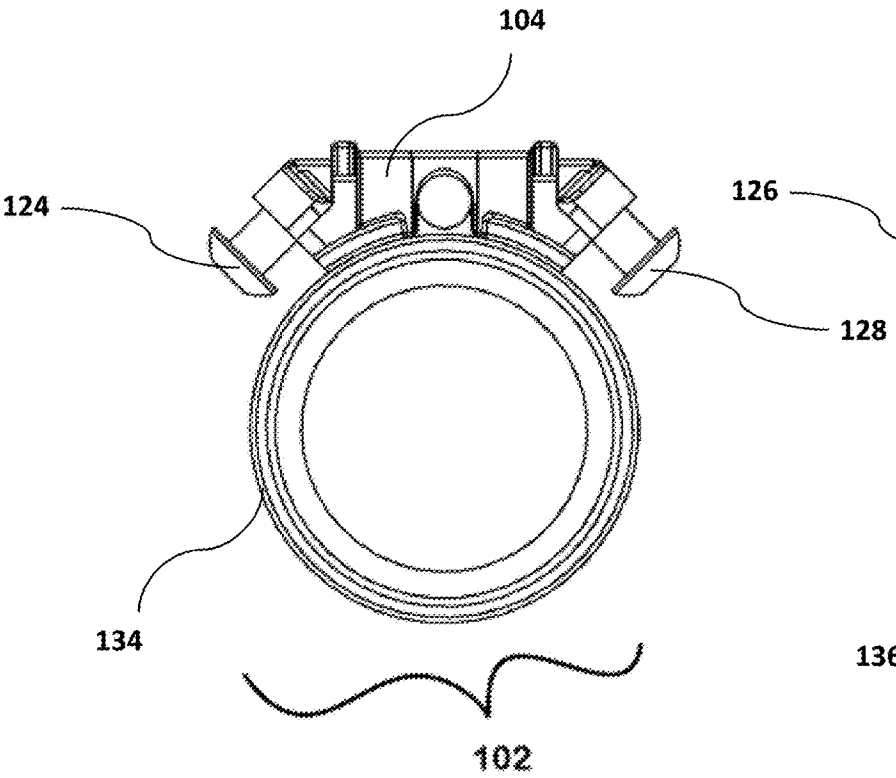
FIG. 1C illustrates a front view of an index block and a barrel nut of an exemplary handguard assembly according to a first embodiment.

Referring now to FIGS. 1C and 1D, a front view and a back view of index block 104 and barrel nut 102 of an exemplary handguard assembly according to the first embodiment are shown, respectively.

Figure 1F:
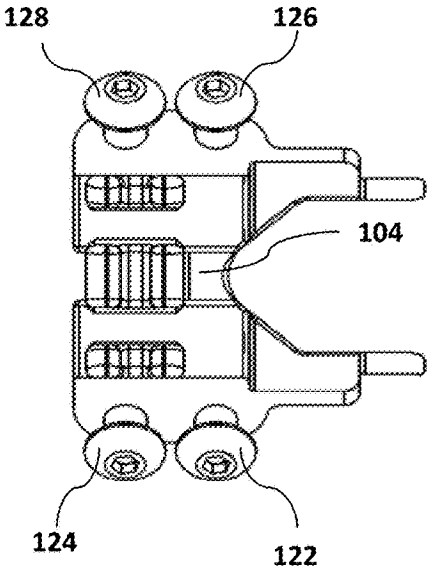
FIG. 1F illustrates a bottom view of an index block of an exemplary handguard assembly according to a first embodiment.
Figure 1E:
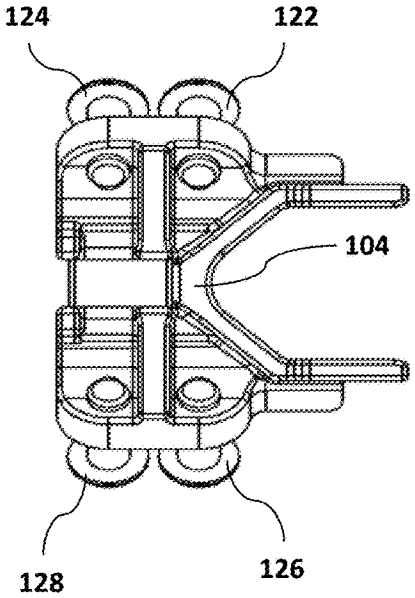
FIG. 1E illustrates a top view of an index block of an exemplary handguard assembly according to a first embodiment.

Referring now to FIGS. 1E and 1F, a top view and a bottom view of index block 104 of an exemplary handguard assembly according to the first embodiment are shown, respectively.

Figure 1G:
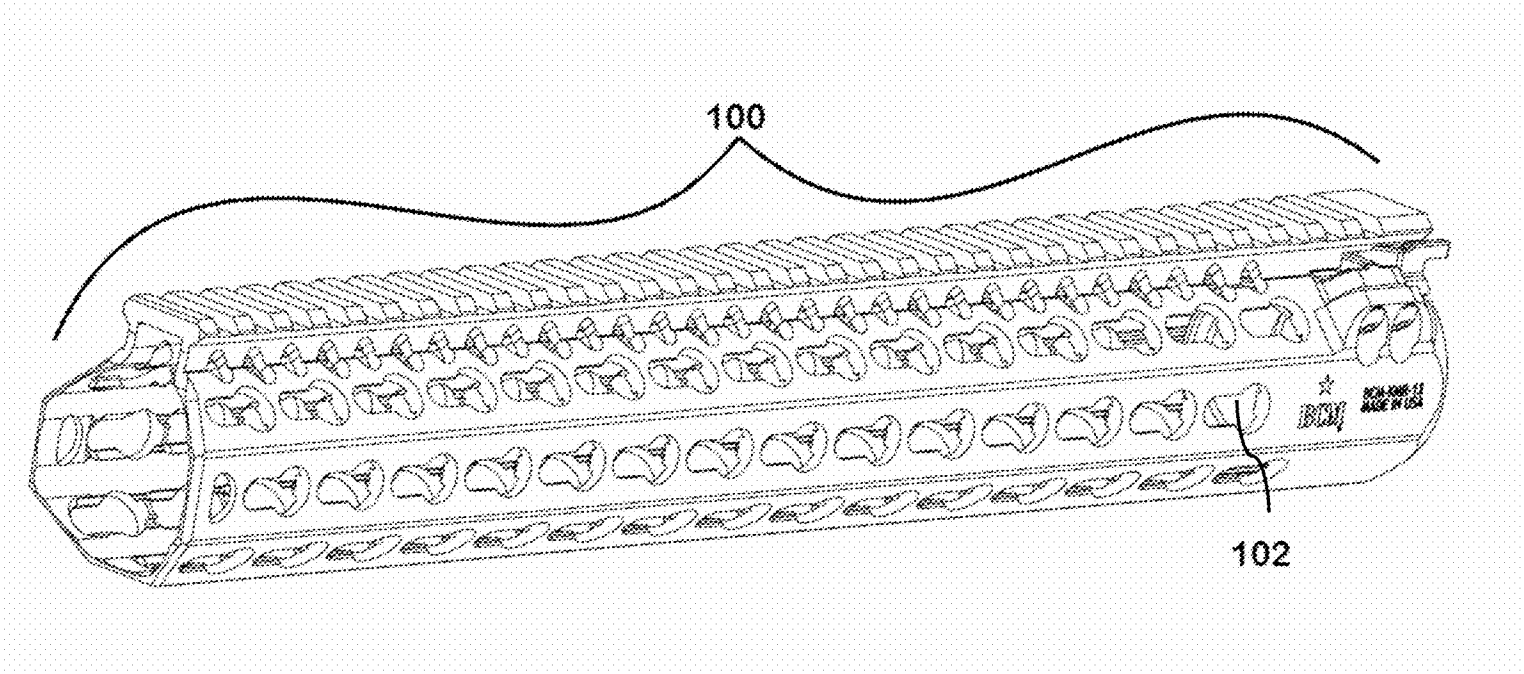
FIG. 1G illustrates a perspective view of a fully assembled exemplary handguard assembly system according to a first embodiment.

Referring now to FIG. 1G, illustrating a fully assembled firearm handguard assembly system according to the first embodiment, the barrel nut 102 is secured inside handguard 100 with screws 122, 124, 126, and 128, and with indexing block 104 in place, allowing handguard 100 to be fully indexed to the upper receiver of the firearm (FIG. 1I). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Figure 1H:
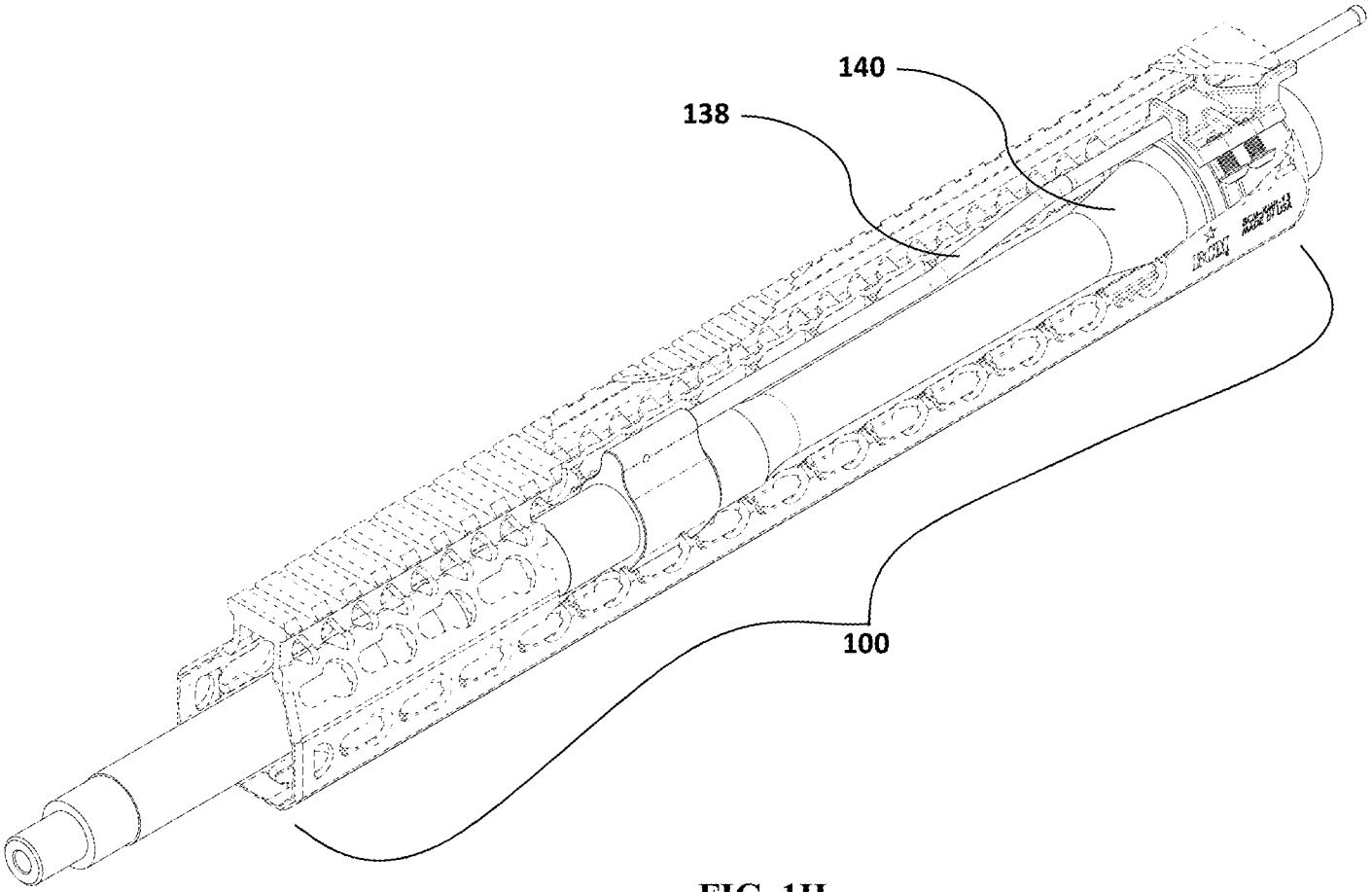
FIG. 1H illustrates a cross-sectional view of a of a fully assembled exemplary handguard assembly system according to a first embodiment.
Figure 11:
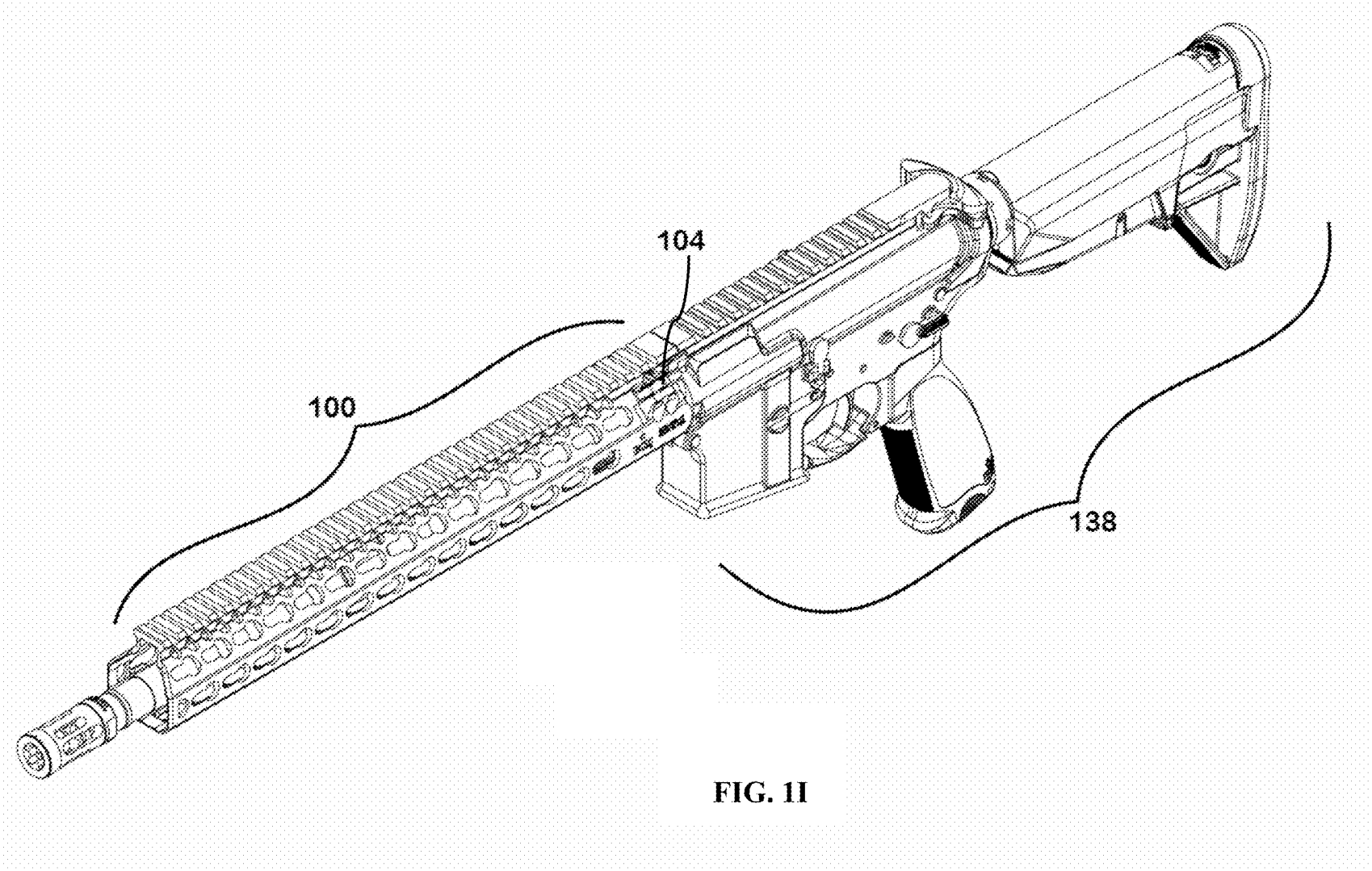

Referring now to FIG. 1H, illustrating a cross-sectional view of a of a fully assembled exemplary handguard assembly system according to the first embodiment, the handguard 100 includes gas tube 138 and barrel 140.

Referring now to FIG. 1I, illustrating a fully assembled firearm handguard on an exemplary firearm according to the first embodiment, the handguard 100 is secured to exemplary firearm 142 at its upper receiver with index block 104 and screws 122, 124, 126, and 128 in place.

Figure 2A:
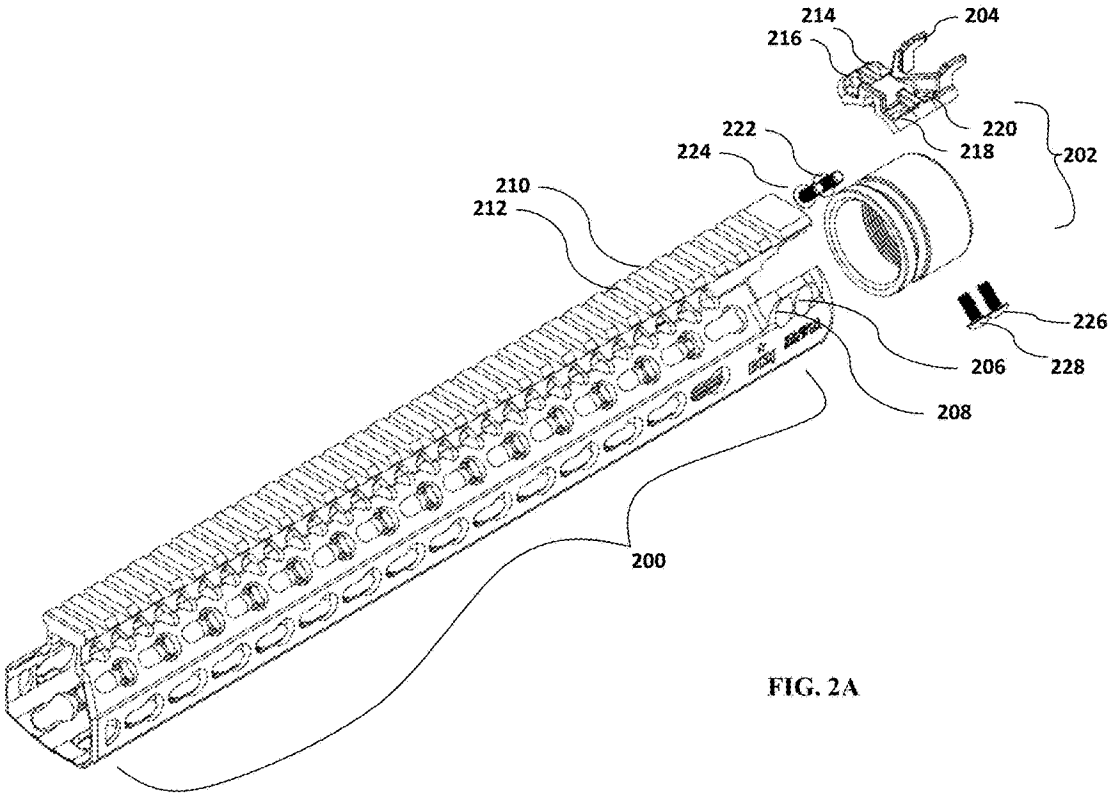
FIG. 2A illustrates an exploded view of an exemplary handguard assembly according to a second embodiment.

Referring now to FIG. 2A, illustrating an exploded view of a firearm handguard assembly system according to a second embodiment, a handguard 200 is coupled to a threaded end of barrel nut 202 to mount the upper receiver of a firearm (FIG. 2I) to handguard 200.

The threaded end of barrel nut 202 is placed inside a first end of handguard 200. Without an index block or plate, the movement of the handguard may loosen the barrel nut and could result in damage to the firearm. Use of index block 204 eliminates rotation of handguard 100 during use.

A first end of handguard 200 contains a first aperture 206 and a second aperture 208 on a first side, and a third aperture 210 and a fourth aperture 212 on a second side. Index block 204 contains a first aperture 214 and a second aperture 216 on a first side, and a third aperture 218 and a fourth aperture 220 on a second side. Index block 204 is placed inside the first end of handguard 200 such that first aperture 214 of index block 204 is aligned with first aperture 206 of handguard 200 and second aperture 216 of index block 204 is aligned with second aperture 108 of handguard 200. On the second side of index block 204, third aperture 218 of index block 204 is aligned with third aperture 210 of handguard 200 and fourth aperture 220 of index block 204 is aligned with fourth aperture 212 of handguard 200.

A first screw 222 is threaded through first aperture 206 of handguard 200 and first aperture 214 of index block 204. A second screw 224 is threaded through second aperture 208 of handguard 200 and second aperture 216 of index block 204. A third screw 226 is threaded through third aperture 210 of handguard 200 and third aperture 218 of index block 204. A fourth screw 228 is threaded through fourth aperture 212 of handguard 200 and fourth aperture 220 of index block 204.

During threading as described above, screws 222, 224, 226, and 228 preclude longitudinal movement of handguard 200, while clamping down on the body of handguard 200 to cause residual force between barrel nut 202 and handguard 200. On an AR-10 platform, the mounting force is spread under the gas tube (see FIG. 2H). The residual mounting force prevents the handguard from flexing or growing, which ultimately prevents rotation and slippage during use.

Figure 2B:
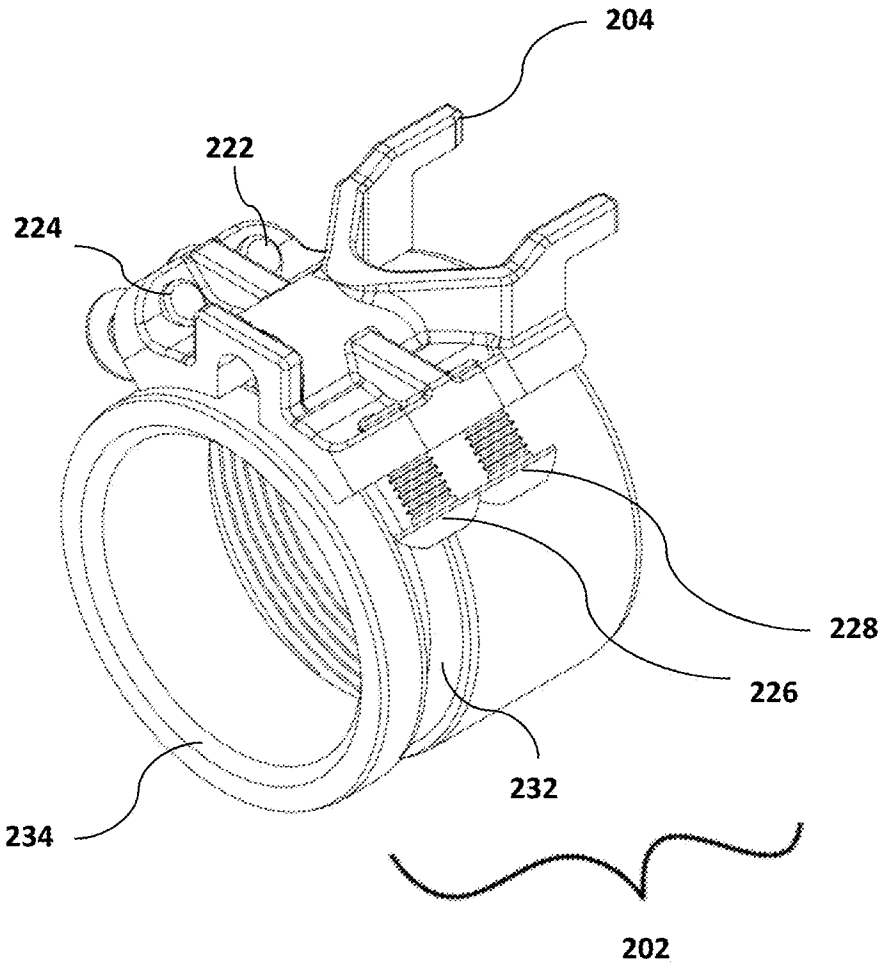
FIG. 2B illustrates a side perspective view of an index block of an exemplary handguard assembly according to a second embodiment.

Referring now to FIG. 2B, a side perspective view of index block 204 and barrel nut 202 of an exemplary handguard assembly according to the second embodiment is shown. Screws 222, 224, 226, and 228 are threaded through index block 204. Index block 204 interfaces with barrel nut 202 in a groove 232 between a first lip 234 of the threaded end barrel nut 202 and a second lip 236 of the smooth end of barrel nut 202.

Figure 2D:
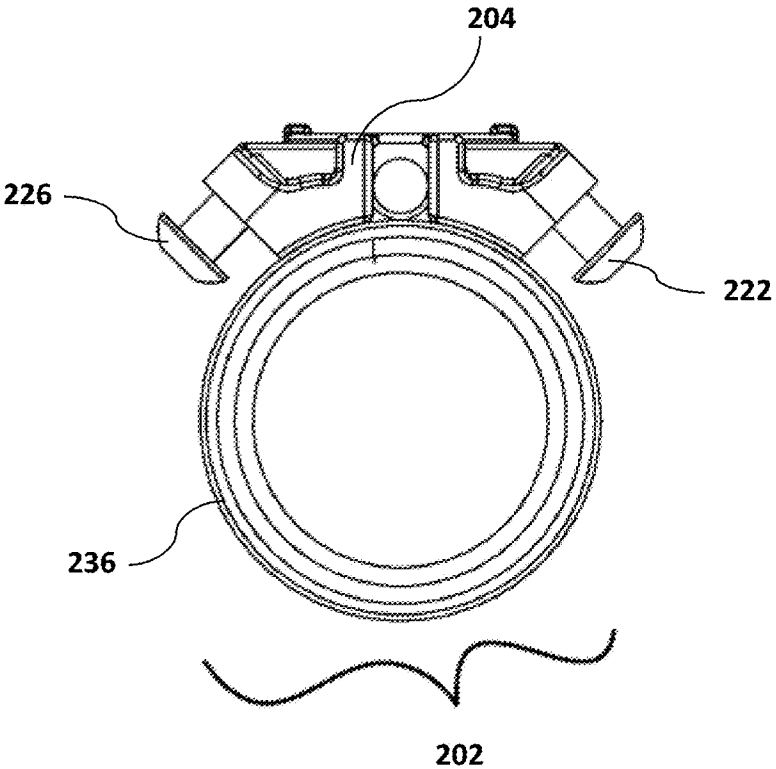
FIG. 2D illustrates a back view of an index block and a barrel nut of an exemplary handguard assembly according to a second embodiment.
Figure 2C:
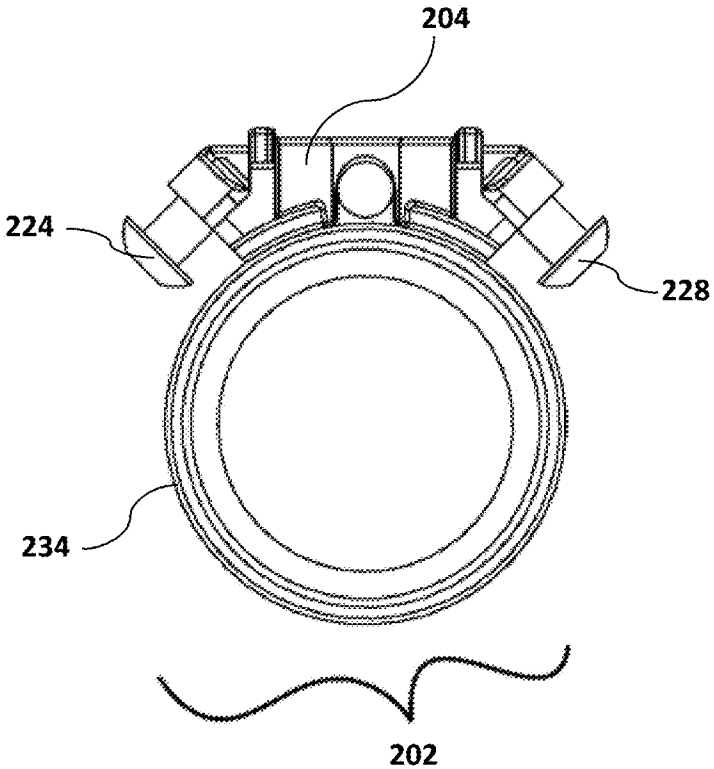
FIG. 2C illustrates a front view of an index block and a barrel nut of an exemplary handguard assembly according to a second embodiment.

Referring now to FIGS. 2C and 2D, a front view and a back view of index block 204 and barrel nut 202 of an exemplary handguard assembly according to the second embodiment are shown, respectively.

Figure 2F:
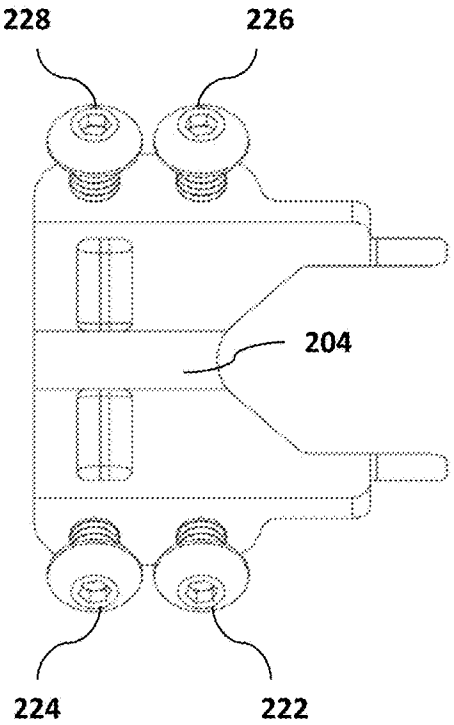
FIG. 2F illustrates a bottom view of an index block of an exemplary handguard assembly according to a second embodiment.
Figure 2E:
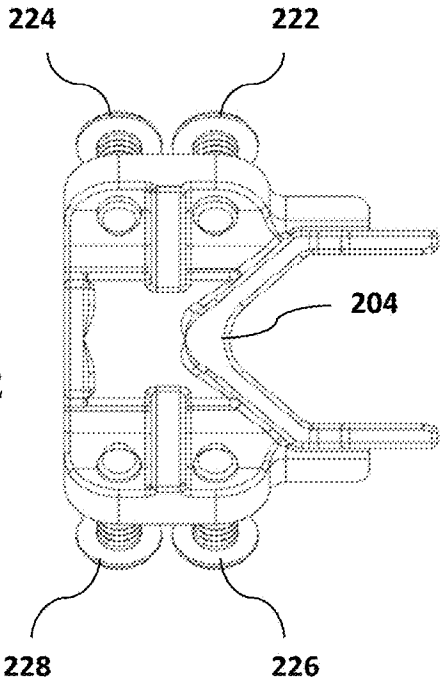
FIG. 2E illustrates a top view of an index block of an exemplary handguard assembly according to a second embodiment.

Referring now to FIGS. 2E and 2F, a top view and a bottom view of index block 204 of an exemplary handguard assembly according to the second embodiment are shown, respectively.

Figure 2G:
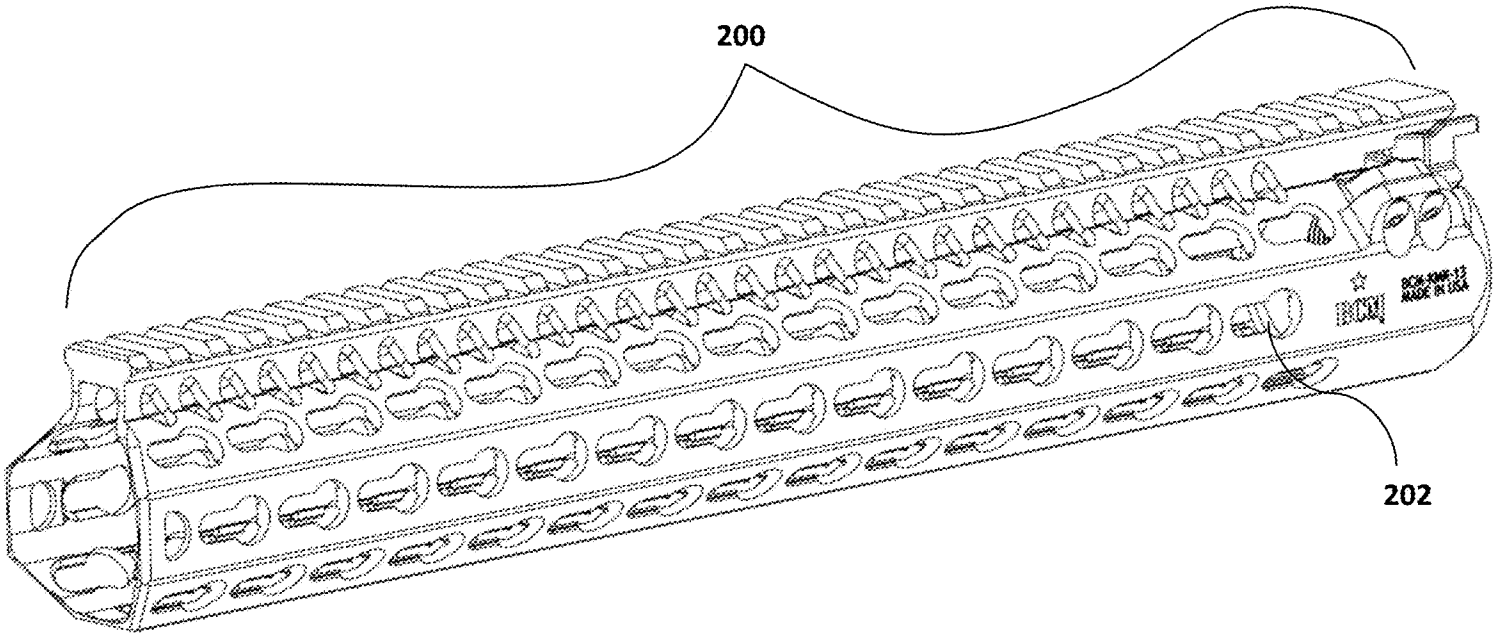
FIG. 2G illustrates a perspective view of a fully assembled exemplary handguard assembly system according to a second embodiment.
Figure 2H:
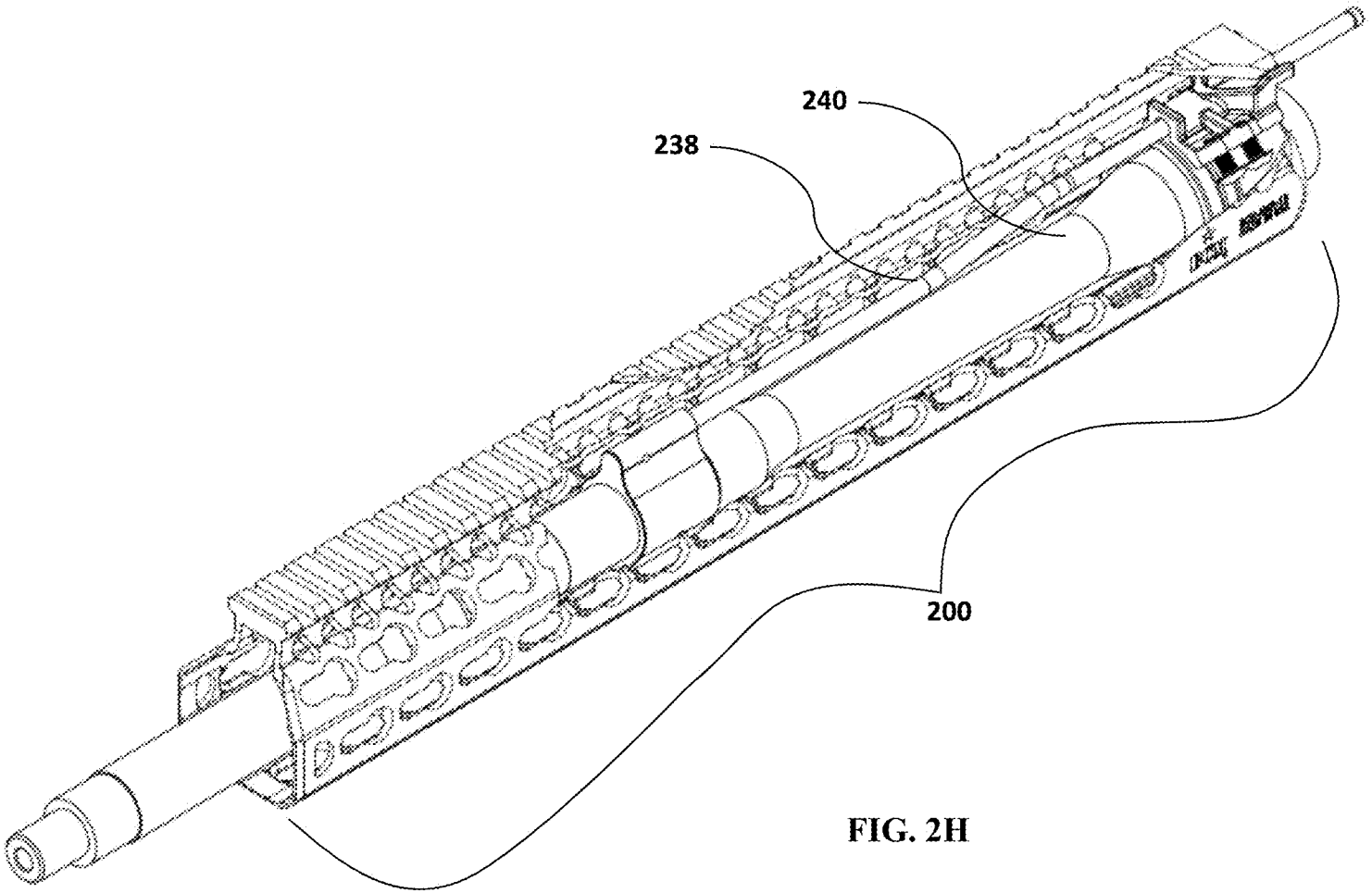
FIG. 2H illustrates a cross-sectional view of a of a fully assembled exemplary handguard assembly system according to a second embodiment.
Figure 2I:
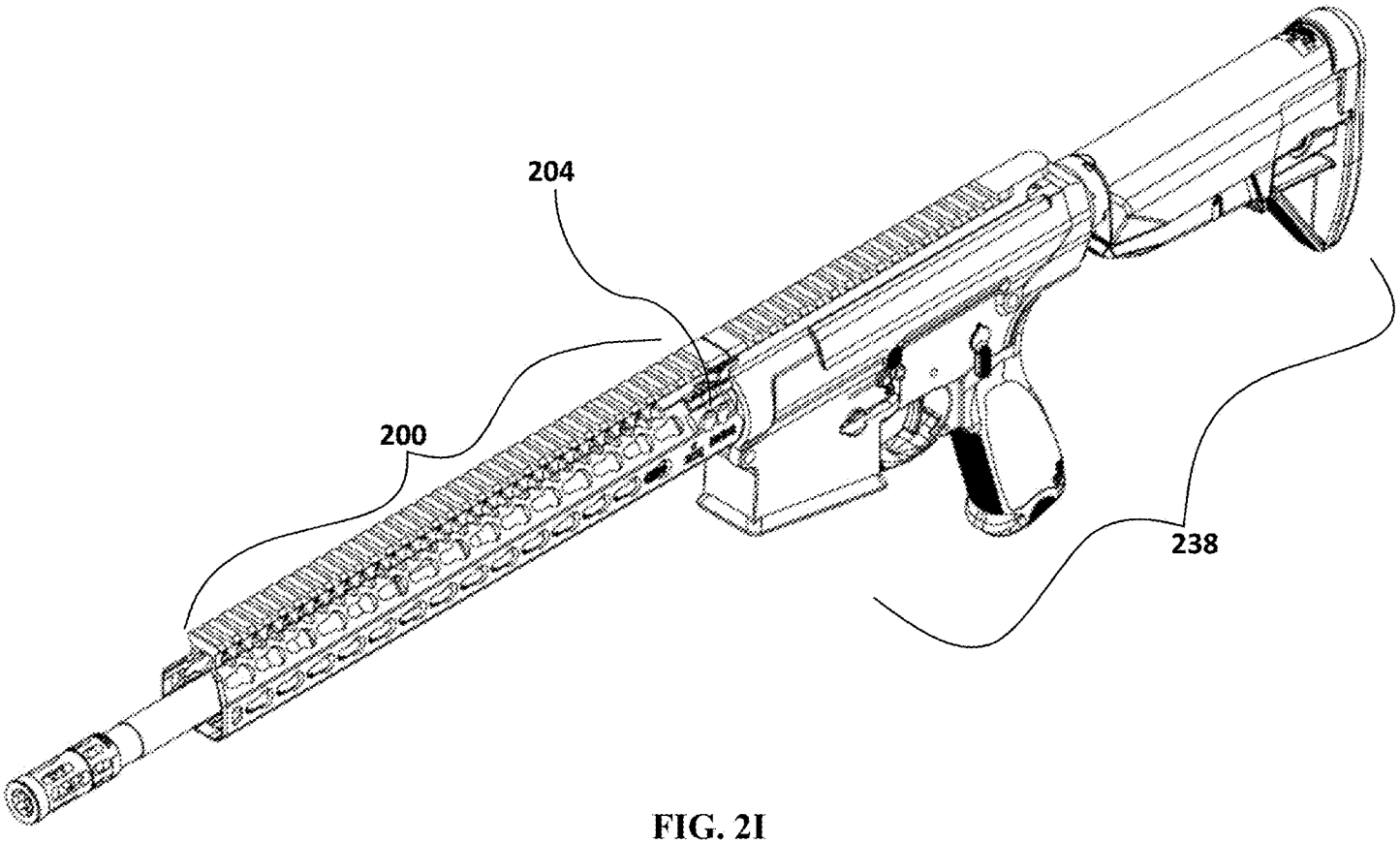
FIG. 2I illustrates a fully assembled firearm handguard assembly system on an exemplary firearm according to a second embodiment.

Referring now to FIG. 2G, illustrating a fully assembled firearm handguard assembly system according to the second embodiment, the barrel nut 202 is secured inside handguard 200 with screws 222, 224, 226, and 228, and with indexing block 204 in place, allowing handguard 200 to be fully indexed to the upper receiver of the firearm (see FIG. 2I). The design of the firearm handguard assembly strengthens the grip of the handguard on the barrel nut, by eliminating non-continuous features within the clamping area of the handguard body, keeping the handguard tensioned in place even under high stress and heat when the firearm is in use.

Referring now to FIG. 2H, illustrating a cross-sectional view of a of a fully assembled exemplary handguard assembly system according to the second embodiment, the handguard 200 includes gas tube 238 and barrel 240.

Referring now to FIG. 2I, illustrating a fully assembled firearm handguard on an exemplary firearm according to the second embodiment, the handguard 200 is secured to exemplary firearm 242 at its upper receiver with index block 204 and screws 222, 224, 226, and 228 in place.

An exemplary firearm may be an AR-10, AR-15, or a variant thereof. The present invention may also be used with any firearm that uses a threaded portion of the forward area of the upper receiver and/or action over which may pass any portion of the operating assembly. By way of example, and not limitation, these firearms may include bolt action rifles for which the user may desire a handguard or fore-end with a top rail and superior clamping force to the receiver. Exemplary embodiments are illustrated herein. The first embodiment, illustrated by FIGS. 1A-1I, shows the present invention on an AR-15 platform. The second embodiment, illustrated by FIGS. 2A-2B, shows the present invention on the AR-10 platform.

Although the exemplary embodiments described herein contain a block and screw assembly that requires one block and four screws, it is contemplated that more or less than four screws may be used. It is also contemplated that the block may be integrated into the handguard body.

The barrel nuts shown in FIGS. 1A-1I and FIGS. 2A-2I use a radial groove long and deep enough to pass a multitude of screws. Alternative embodiments of the barrel nut include, but are not limited to, a barrel nut design containing a plurality of apertures to allow the screws to pass through the apertures and engage the index block; a barrel nut design with a plurality of flat cuts that create clearance for the screws to pass; a barrel nut design with no forward flange but with a protrusion to support the screws; a barrel nut design without any forward flange, no clearance cuts, and which may have screws passing only in front of, or in front of and behind, the barrel nut in order to engage the apertures on either side of the handguard. The barrel nut and related metal mounting hardware made from any suitable structural material may be used in connection with the present invention, including without limitation steel (carbon and stainless) and titanium.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. To the contrary, the present descriptions are intended to cover alternatives, modifications, and equivalents as may be included within the spirit and scope of the invention as defined by the appended claim and otherwise appreciated by one of ordinary skill in the art.

What is claimed is:

1. A firearm handguard assembly system, the system comprising:

a handguard including at least four apertures;

a barrel nut having:

a first threaded end and a second smooth end, the first threaded end coupled to the handguard, and a groove between a first lip on the first threaded end and a second lip on the second smooth end; and an index block including at least four apertures and one or more feet, the index block coupled to the handguard by at least four screws, each screw having a head and a tip, the tip threaded through: one of the at least four apertures on the index block, and one of the at least four apertures on the handguard, and the one or more feet interfaces with the groove of the barrel nut between the first lip and the second lip.

2. The system of claim 1, wherein the firearm handguard assembly system further includes a gas tube.

3. The system of claim 2, wherein the threading of the screws produces a residual force around the gas tube.

4. The system of claim 2, wherein the threading of the screws produces a residual force under the gas tube.

5. The system of claim 1, wherein the handguard is comprised of magnesium.

6. The system of claim 1, wherein the handguard contains a picatinny rail.

7. The system of claim 1, wherein the handguard contains keymod holes.

8. A firearm comprising:

an upper receiver;

a handguard including at least four apertures; and a handguard assembly system for mounting the handguard to the upper receiver, the handguard assembly system comprising:

a barrel nut having a first threaded end and a second smooth end, the first threaded end coupled to the handguard, a groove between a first lip on the first threaded end and a second lip on the second smooth end, and an index block including at least four apertures and one or more feet, the index block coupled to the handguard by at least four screws, each screw having a head and a tip, the tip threaded through: one of the at least four apertures on the index block, and one of the at least four apertures on the handguard, and the one or more feet interfaces with the groove of the barrel nut between the first lip and the second lip.

9. The firearm of claim 8, wherein the firearm handguard assembly system further includes a gas tube.

10. The firearm of claim 9, wherein the threading of the screws produces a residual force around the gas tube.

11. The firearm of claim 9, wherein the threading of the screws produces a residual force under the gas tube.

12. The firearm of claim 8, wherein the handguard is comprised of magnesium.

13. The firearm of claim 8, wherein the handguard contains a picatinny rail.

14. The firearm of claim 8, wherein the handguard contains keymod holes.

* * * * *